United States Patent [19]

Ciavatta

[11] 4,316,677

[45] Feb. 23, 1982

[54] TUBULAR SHANK DEVICE

[76] Inventor: Armand Ciavatta, 703 Birch Hill Dr., Bridgewater, N.J. 08807

[21] Appl. No.: 127,959

[22] Filed: Mar. 7, 1980

[51] Int. Cl.[3] ..... E21D 21/00

[52] U.S. Cl. ..... 405/259; 411/61

[58] Field of Search ..... 405/259–261; 411/55, 61, 520, 544, 545, 32, 15

[56] References Cited

U.S. PATENT DOCUMENTS

| | | | |
|---|---|---|---|
| 590,953 | 10/1897 | Barnes | 411/61 X |
| 590,954 | 10/1887 | Barnes . | |
| 969,550 | 9/1910 | MaGee et al. | 411/61 |
| 1,637,419 | 8/1927 | Klein | 411/61 |
| 1,669,014 | 5/1928 | Ogden | 411/61 |
| 2,014,892 | 9/1935 | Graham et al. | 238/29 |
| 2,566,573 | 9/1951 | Lyon | 188/83 |
| 2,682,152 | 6/1954 | Bierer | 405/260 |
| 3,349,567 | 10/1967 | Munn | 405/259 |
| 3,425,311 | 2/1969 | Levy | 85/8.3 |
| 3,630,261 | 12/1971 | Gley | 151/70 |
| 3,653,217 | 4/1972 | Williams | 61/45 B |
| 3,819,101 | 6/1974 | Elders et al. | 405/259 X |
| 3,863,825 | 2/1975 | Elders et al. | 405/259 X |
| 3,922,867 | 12/1975 | Scott | 405/259 X |
| 4,040,260 | 8/1977 | Pryke | 405/239 |

FOREIGN PATENT DOCUMENTS

| | | | |
|---|---|---|---|
| 2109599 | 8/1972 | Fed. Rep. of Germany | 411/61 |
| 1525224 | 4/1968 | France | 411/61 |
| 434471 | 6/1948 | Italy . | |
| 670870 | 4/1952 | United Kingdom | 411/61 |

*Primary Examiner*—Dennis L. Taylor

*Attorney, Agent, or Firm*—Cushman, Darby & Cushman

[57] ABSTRACT

A device that has a tubular shank can be employed either for fastening or for stable mounting in unconsolidated underground strata. This shank has an oblate cross-section. For applications in which the device is driven into underground strata, the shank has a length sufficient to avoid loosening, notwithstanding possible shifting of unconsolidated strata. The shank is drivable into a bore that is sized to transversely compress the shank.

16 Claims, 14 Drawing Figures

FIG. 11
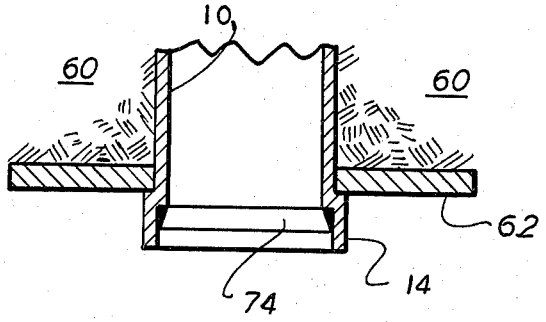
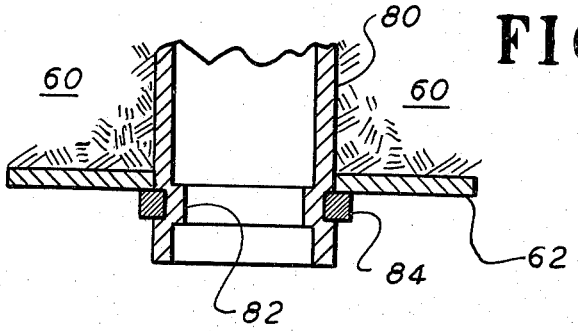
FIG. 12
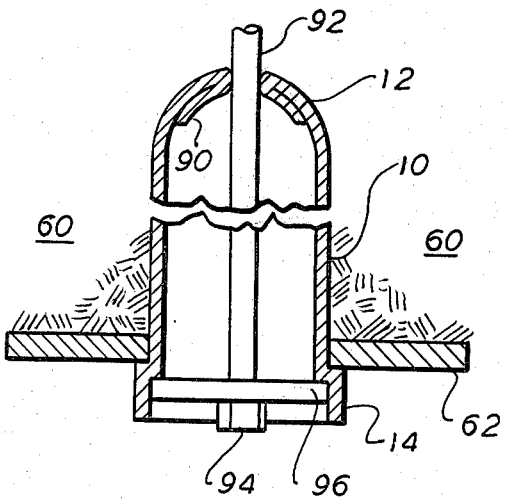
FIG. 13
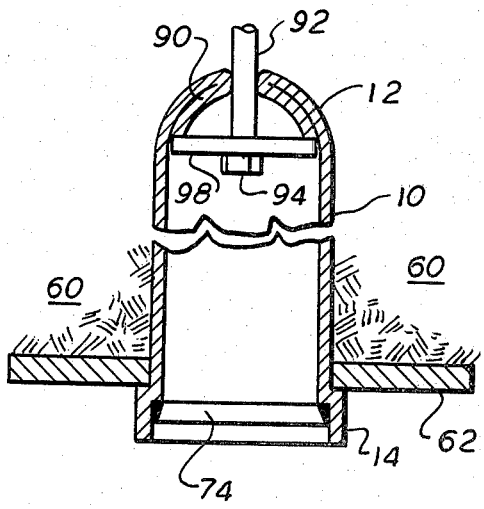
FIG. 14

TUBULAR SHANK DEVICE

BACKGROUND OF THE INVENTION

The present invention relates to tubular devices which can be force fitted into a bore and, in particular, to devices which are used to either stabilize underground strata or to fasten.

It is known to provide a fastener in the form of a spring pin which is a generally compressible sleeve that can be force fitted into a hole. In addition, it is known to employ a sleeve having an elliptical cross-section which is mounted in a hole and expanded by driving a pin into the sleeve. However, this latter sleeve is relatively small and is dimensioned primarily for use as a wall fastener. Thus it does not have sufficient length to stabilize it in unconsolidated rock strata. Furthermore, such sleeves do not have a smooth convex perimeter. Instead they are formed of sheet metal with an overlapping seam. Finally, in the mining art it is known to employ a split cylindrical sleeve which is force fitted into a bore drilled into underground strata.

SUMMARY OF THE INVENTION

In accordance with the illustrative embodiments demonstrating features and advantages of the present invention, there is provided a device stably mountable in unconsolidated underground strata comprising a tubular shank. The tubular shank has an oblate cross-section. The length of this shaft is sufficient to stabilize it from loosening in underground strata. Thus the shank is forwardly drivable into a bore that is sized to transversely compress the shank.

According to a related aspect of the present invention there is provided a fastening device comprising a tubular shank having an aft cylindrical portion and a central portion. The central portion has an oblate cross-section. Another related aspect of the present invention provides a fastening device having a tubular shank with an oblate cross-section whose outer perimeter is convex. That shank has a spiral rib.

An associated method of the present invention allows installation of a tubular fastening device into a bore. The steps of the method include aligning a plate having an oblate aperture over the mouth of this bore and driving the tubular fastening device through the oblate aperture. The oblate aperture correspondingly shapes the tubular device and force fits it into the bore.

By employing apparatus and methods according to the foregoing, a highly effective and reliable device is provided which may be stably mounted in unconsolidated rock strata or used generally to fasten. The device relies primarily upon frictional forces to keep it in place. The shank has a major diameter which exceeds the diameter of the bore into which it is driven. Accordingly, the shank is compressed from its oblate shape into a nearly circular shape. This compression causes the shank to hug the bore along its entire length. This feature renders the shank relatively immune to vibration or shifting of strata about the bore.

In one embodiment of the present invention the tubular shank has an elliptical cross-section and a spiral outer surface. Essentially, the outer surface is produced by rotating the elliptical cross-section at progressive positions along a central axis of the tubular shank. Such a spiral device can be driven and twisted into a bore to provide intimate frictional contact along the entire length of the shank. Another embodiment of the present invention employs an elliptical cross-section centered on a jogged axis so that the outer surface of the shank undulates to provide a surface that grips the bore at regular intervals.

In another embodiment, the aft portion of the tubular shank is cylindrical and has a diameter which is less than the major diameter of the elliptical portion of the shank. Accordingly, this aft cylindrical portion tends to moderate the overall driving force required to fully set the shank into a bore. This feature is significant when consideration is given of the high driving force required to insert the shank, especially for the last foot or so. By structuring the aft portion of the shank to be cylindrical and smaller it reduces this final driving force. Alternatively, the shank can have throughout its length a similar oblate cross-section whose size is gradually reduced toward the aft end. The reverse function can be provided by reversing the taper of the shank so that the size of the aft portions are larger. This latter feature provides greater gripping near the surface of the strata where shifting may be more severe.

Also in some embodiments, the aft portion of the shank will have several flattened surfaces. For example, a portion of the cylindrical surface can be shaped like a hex nut to allow the shank to be twisted into the bore by an appropriate tool.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein:

FIG. 11 is a detailed sectional view of an aft end which is alternate to that of FIG. 9;

FIG. 12 is a detailed sectional view of an aft end which is alternate to that of FIG. 9;

FIG. 13 is a sectional view of the shank of FIG. 1, shown installed together with a known roof bolt; and FIG. 14 is a sectional view of the shank of FIG. 11, shown installed with a known roof bolt.

DETAILED DESCRIPTION OF THE PREFERRED EMBODIMENTS

Figure 1:
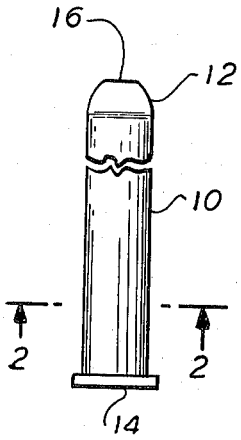
FIG. 1 is a side view of a tubular shank according to the present invention.
Figure 2:
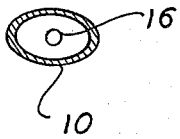
FIG. 2 is a sectional view along lines 2—2 of FIG. 1.

Referring to FIGS. 1 and 2, a tubular shank 10 is shown having the oblate cross-section illustrated in FIG. 2. The cross-section of FIG. 2 is essentially elliptical although it is anticipated that oval, polygonal, convex and other shapes may be employed instead. It is preferred that the perimeter of the cross-section of FIG. 2 be convex to facilitate installation. If the shank was formed of overlapped sheet metal it would have a ridge that would make it partly concave. Shank 10 has blunted, hemispherically domed, forward end 12 and a flared aft end 14. End 12 has an open mouth 16. It will be appreciated that various tapered and flared shapes may be employed for ends 14 and 16. Although shank 10 is for the most part a uniform elliptic cylinder, in some embodiments the shank will converge slightly toward the rear. This feature raises initial insertion force but moderates final insertion force. Alternatively, shank 10 can be an elliptic cylinder that converges slightly toward the front. This latter feature provides greater gripping action near the surface, where the strata may tend to shift.

For those embodiments wherein shank 10 is to be stably mounted in underground strata, the shank should be more than one foot long to perform this task. For example, in some embodiments the overall length of the tubular shank will be about 5 feet. In addition, for this embodiment the tubular shank had an elliptical cross-section with a major diameter of 1.38 inches and a minor diameter of 1.12 inches. The shank was formed of steel having a wall thickness of 0.075 inch. It is to be appreciated that alternate thicknesses, lengths and diameters can be employed instead of the foregoing depending upon the particular application for which the device is intended. This foregoing embodiment was designed to be driven into a 1.280 inch bore hole. It is to be noted that this is an interference fit so that shank 10 must be compressed by reducing its major diameter and expanding its minor diameter. Accordingly, the cross-section of shank 10 becomes formed more like a circle. It is preferred that the walls of shank 10 will be designed to cause inelastic yielding when shank 10 is driven into its bore. For embodiments (described hereinafter) wherein the shank has a reduced diameter section, that section may be stressed less and experience elastic deformation only.

Figure 3:
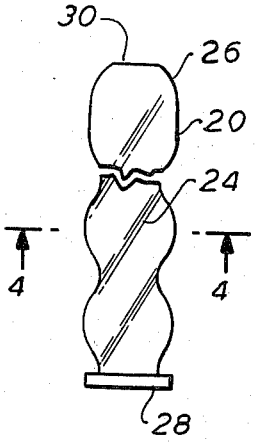
FIG. 3 is a side view of an alternate tubular shank according to the present invention.
Figure 4:
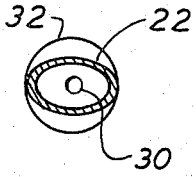
FIG. 4 is a sectional view along lines 4—4 of FIG. 3.

Referring to FIGS. 3 and 4, an alternate shank 20 is illustrated which has the elliptical cross-section 22 shown in FIG. 4. The outer surface shown in FIG. 3 is formed essentially by uniformly rotating an ellipse as it progresses down the longitudinal axis of shank 20. The shape thus formed is deemed to have spiral ribs, as suggested by the spiral lines such as line 24. Shank 20 again has a tapered, hemispherical forward end 26 and a flared end 28. The domed end 26 is open at mouth 30. Referring to FIG. 4, it is to be appreciated that the elliptical cross-section 22 is shown surrounded by a circular area 32 since this area is formed by the rotation of the ellipse beyond cross-section 22.

Figure 5:
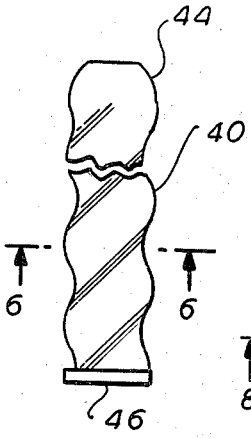
FIG. 5 is a side view of an alternate tubular shank according to the present invention.
Figure 6:
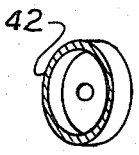
FIG. 6 is a sectional view along lines 6—6 of FIG. 5.

Referring to FIGS. 5 and 6, an alternate shank 40 is illustrated which has elliptical cross-section 42. The shank 40 has a constant elliptical cross-section but which shifts transversely along the longitudinal axis of the shank. This shifting, however, is in one direction only. In this embodiment the shifting is parallel to the minor axis of elliptical cross-section 42. Thus, it is appreciated that the side view of shank 40, if rotated 90° about its longitudinal axis, will appear identical to the shank of FIG. 1. Shank 40, again has a domed forward end 44 and a flared outer end 46.

Figure 7:
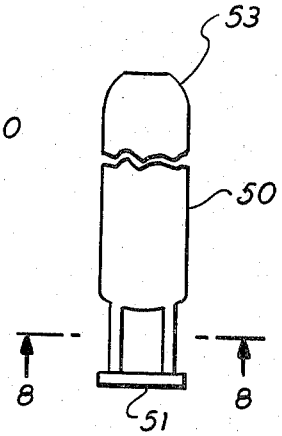
FIG. 7 is a side view of an alternate tubular shank according to the present invention.
Figure 8:
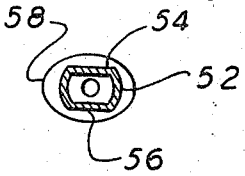
FIG. 8 is a sectional view along lines 8—8 of FIG. 7.

Referring to FIGS. 7 and 8, a tubular shank 50 is shown which has a domed forward end 53 and, at its mid-point, an elliptical cross-section which is identical to that illustrated in FIG. 2. The portion at lines 8-8 is referred to herein as an aft cylindrical portion adjacent a central portion. Essentially, lower cross-section 52 is circular except for flattened opposing surfaces 54 and 56. It is to be appreciated that in some embodiments these flattened surfaces will be deleted or the number of flattened surfaces will be increased to provide a hexagonal or other polygonal shape. It is important to note that the outer perimeter of lower cross-section 52 is smaller than the perimeter of the central portion 58 of shank 50. This feature allows the shank to be easily inserted into a bore, since the frictional forces due to circular cross-section 52 are relatively small. Consequently, the force required to drive the last foot or so of shank 50 will not significantly increase. Thus the tendency for flared end 51 to bend or crush is reduced.

Figure 9:
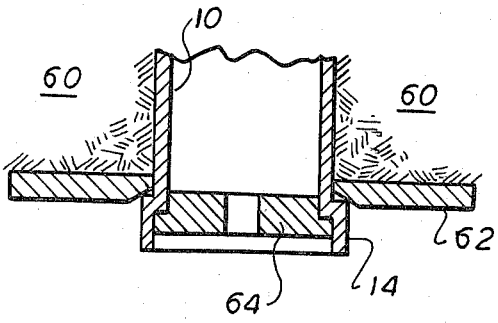
FIG. 9 is a detailed sectional view of the aft end of the tubular shank of FIG. 1 showing it installed.

Referring to FIG. 9, a detailed, transverse sectional view of the aft end of the shank of FIG. 1 is given. Shank 10 has flared end 14 which is essentially a cylindrical butt of increased diameter. Shank 10 is shown embedded in a circular bore in strata 60. An apertured plate 62 is shown encircling shank 10 forward of flared end 14.

Annulus 64, used in this embodiment, is an apertured cylindrical disc coaxially fitted within the flared end 14 of shank 10. Annulus 64 provides a surface for applying a driving force to seat shank 10 into strata 60. In addition, by spanning the inner sidewalls of flared end 14, annulus 64 provides reinforcement which prevents bending or crushing of flared end 14.

For those embodiments in which the portion of shank 10 adjacent end 14 is an elliptic cylinder, it is preferred to have an elliptical aperture in plate 62. However, it is anticipated that for many embodiments a circular aperture will be employed instead. This aperture will have an inside diameter matching the major diameter of the elliptic cylinder.

The shank of FIG. 9 is readily installed by aligning its forward domed end and the aperture in plate 62 with the bore in strata 60. Thereafter a pneumatic hammer or similar device is applied against pusher disc 64, thereby driving shank 10 into strata 60 until it is in the position illustrated in FIG. 9. It is to be appreciated that the bore in strata 60 is smaller than the unstressed major diameter of shank 10. Accordingly, shank 10 is compressed along its entire length and is thus firmly held within strata 60. This frictional feature is important where the strata may shift due to blasting or natural shifting. Under such conditions shank 10 may bend or be severely deformed. However, it will not tend to loosen since it applies frictional force along its entire length.

Figure 10:
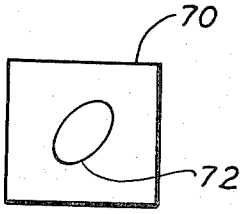
FIG. 10 is a plan view of a member used in installing the shank of FIG. 1.

It is anticipated that in some instances the elliptical shape previously described will be formed at the installation site. This shaping can be performed with a die member such as the plate shown in FIG. 10. Die member 70 has elliptical aperture 72. Accordingly, a cylindrical tube can be forced through member 70, thereby deforming the tube. Thus deformed, the tube acts similar to the shanks previously described.

Referring to FIG. 11, an alternate device is illustrated which is identical to the apparatus of FIG. 9 except that weld bead 74 is included instead of an internal pusher disc. Bead 74 is inserted at the inside corner formed by the outwardly diverging and rearwardly directed portion of flared end 14. The bead 74 acts like a brace to transfer shear forces inwardly so they act centrally along the walls of shank 10, thus increasing the size of the shear plane. Also bead 74 reinforces flared end 14 so that it maintains its shape and does not crush or allow plate 62 to slip by.

Referring to FIG. 12, an alternate tubular shank 80 is illustrated. Shank 80 is shaped the same as the shank of FIG. 1 except that annular crimp 82 is provided instead of a flared end. Fitted into crimp 82 is retaining ring 84 which holds plate 62 in place against strata 60. Crimp 82 has a depth that preferably equals half of the wall thickness of shank 80, although this depth is not exclusive. The area of the shear plane within the device of FIG. 12 will be greatest when the floor of crimp 82 falls somewhere between the inside and outside diameter of shank 10.

Referring to FIG. 13, the shank 10 of FIG. 1 is shown installed in a bore in strata 60. As before, a roof plate 62 is pressed against strata 60 by the flared end 14 of shank 10. In this embodiment domed end 12 has inwardly bent tab 90, although other embodiments will not include such a tab.

Mounted coaxially within shank 10 is a conventional roof bolt 92 which extends beyond domed end 12. Bolt 92 has a conventional anchor (not shown) at its forward end. The aft end of bolt 92 is formed into bolt head 94. Bolt head 94 presses retaining member 96 into flared end 14 of shank 10. Retaining member 96 is shaped as a large flange in this embodiment.

The equipment of FIG. 13 is installed by inserting bolt 92 into shank 10 with the anchor (not shown) on the tip of bolt 92 and retaining member 96 on bolt 92 between head 94 and flared end 14. The combination of FIG. 13 is inserted into the bore of strata 60. It is driven in by applying an air hammer or other suitable tool to retaining member 96. Once roof plate 62 is held firmly against strata 60, bolt head 94 is rotated to plant its anchor and put bolt 92 into tension.

Thus assembled, plate 62 is held in by two mechanisms: the frictional force of shank 10 and the anchoring force of bolt 92. These two mechanisms produce orthogonal compressive forces. Shank 10 produces transverse compression against the strata and bolt 92 longitudinal compression. An advantage of the foregoing combination is that the effective length of the combination can be significantly increased without a corresponding increase in the driving force needed to seat shank 10.

It is also anticipated that for some embodiments the equipment of FIG. 13 will be appropriately apertured to allow injection of a well known resin or cement which surrounds and secures bolt 92 within its bore.

Referring to FIG. 14, an installation similar to FIG. 13 is shown, except bolt head 94 holds retaining member 98 against tab 90 in the domed end 12 of shank 10. This particular embodiment employs the reinforcing weld bead previously described in FIG. 11. The equipment of FIG. 14 is installed similarly to that of FIG. 13. However, it is convenient to apply alternatively a driving hammer against flared end 14 (FIG. 14) and retaining member 98. Thereafter bolt 92 can be put into tension and its anchor set by rotating bolt head 94 with an appropriate tool.

It is to be appreciated that various modifications may be implemented with respect to the above described preferred embodiments. For example, various dimensions can be altered to accomodate different applications. In addition, alternate materials may be substituted to provide the desired strength, weight, holding capacity etc. In addition, the surfaces may be roughened or corrugated to provide additional frictional forces. Furthermore, the shank cross-sections may be elliptical, oval, polygonal or other oblate shapes. In addition, it is anticipated that for some embodiments the surface of the flared end may be flattened into a hexagonal prism so that it can be used as a bolt head to drive and twist the shank into its bore. Also, in embodiments including an anchoring device, such as shown in FIG. 14, the shank may have various cross-sections including circular.

Obviously many other modifications and variations of the present invention are possible in light of the above teachings. It is therefore to be understood that within the scope of the appended claims, the invention may be practiced otherwise than as specifically described.

What is claimed is:

1. A device stably mountable in unconsolidated underground strata comprising:

a tubular shank having an oblate cross-section, said shank having a length sufficient to stabilize it from loosening in said underground strata, whereby said shank is forwardly drivable into a bore that is sized to transversely compress said shank, said oblate cross-section providing annularly spaced wall engaging peripheral portions for frictionally engaging the wall of a bore in the strata and annularly spaced non-wall engaging peripheral portions which are spaced radially from the wall of the bore, said portions being integrally interconnected in annular force translating relation throughout a substantial portion of the length of the tubular shank such that frictional interengagement with the wall of the bore will result in a radially inward deflection of said wall engaging portions which deflection is accommodated by radially outward deflection of said non-wall engaging portions.

2. A device according to claim 1 wherein said shank comprises:

an elliptic cylinder having a tapered forward end.

3. A device according to claim 1 wherein said tapered forward end is domed.

4. A device according to claim 1 wherein said shank has a spiral rib.

5. A device according to claim 1 wherein said shank is undulated in a given transverse direction, said transverse direction being parallel to the chord of said oblate cross-section which defines its minimum thickness.

6. A device according to claim 2 wherein said shank has a flared aft end.

7. A device according to claim 1 wherein said shank has a smaller aft section adjacent an end of the shank, said aft section being sized to cause less friction than portions having said oblate cross-section, whereby the force required to fully drive said shank into said bore is reduced due to said aft portion.

8. A device according to claim 6 further including:

an annulus coaxially mounted in the flared end of said shank, said annulus having an inside diameter smaller than that of said shank, said annulus being sized to reinforce and provide a ramming surface for said shank.

9. A device according to claim 6 wherein said shank has at least one flat surface sized to allow gripping and twisting thereof by a tool.

10. A device according to claim 6 wherein said flared end has an outwardly diverging section followed by a rearwardly directed section, said flared end including on its inside surface a weld bead at the intersection of said diverging and said rearwardly directed section.

11. A device according to claim 1 wherein said shank has an annular crimp near its aft end, said device further comprising:

a retaining ring mounted in and extending outwardly from said crimp, said crimp having a depth less than the wall thickness of said tubular shank.

12. A device according to claim 1 wherein said shank has a central section that converges in a rearward direction whereby final insertion force is moderated.

13. A device according to claim 1 wherein said shank has a central section that converges in a forward direction, whereby gripping is relatively greater toward the aft of said shank.

14. A device according to claim 1 wherein said shank has a larger aft section adjacent an end of said shank, said aft section being sized to provide relatively greater gripping toward the aft of said shank.

15. A device according to claim 1 wherein said shank is associated with a plate having a central aperture therein of a shape operable to deform a tubular cylindrical blank forced longitudinally therethrough into said tubular shank having said oblate cross-section.

16. A device according to claim 15 wherein said aperture and oblate cross-section are elliptical.

* * * * *